US009609900B2

(12) United States Patent
Schild

(10) Patent No.: US 9,609,900 B2
(45) Date of Patent: Apr. 4, 2017

(54) GLOVES WITH SELECTIVE INSERTS ABOUT THE PROXIMAL AND DISTAL INTERPHALANGEAL JOINTS OF THE HAND

(71) Applicant: Shawn Schild, Blackfoot, ID (US)

(72) Inventor: Shawn Schild, Blackfoot, ID (US)

( * ) Notice: Subject to any disclaimer, the term of this patent is extended or adjusted under 35 U.S.C. 154(b) by 82 days.

(21) Appl. No.: 14/713,331

(22) Filed: May 15, 2015

(65) Prior Publication Data

US 2016/0331050 A1 Nov. 17, 2016

(51) Int. Cl.
*A41D 19/00* (2006.01)
*A41D 19/015* (2006.01)

(52) U.S. Cl.
CPC ..... *A41D 19/015* (2013.01); *A41D 19/00* (2013.01)

(58) Field of Classification Search
CPC .... A41D 19/00; A41D 19/002; A41D 19/015; A63B 71/148
USPC ..... 2/159, 160, 163, 161.1, 161.5, 161.6
See application file for complete search history.

(56) References Cited

U.S. PATENT DOCUMENTS 2,036,413 A * 4/1936 Herbruck ..... A41D 19/0062 174/5 SB
3,997,922 A * 12/1976 Huhta ..... A41D 19/00 2/161.1
4,441,213 A * 4/1984 Trumble ..... A41D 19/0058 2/16
4,494,249 A * 1/1985 Hansson ..... A41D 19/00 2/161.6
4,561,122 A * 12/1985 Stanley ..... A41D 19/015 2/161.1
4,654,896 A * 4/1987 Rinehart ..... A41D 19/02 2/161.6
4,930,162 A * 6/1990 Cote ..... A63B 71/143 2/16
5,323,490 A * 6/1994 Yarbrough ..... A41D 19/0062 2/161.7
5,488,739 A * 2/1996 Cardinal ..... A63B 71/143 2/16
5,768,711 A * 6/1998 Wissink ..... A41D 19/0034 2/160
5,857,216 A * 1/1999 Gold ..... A41D 19/02 2/169
5,881,388 A * 3/1999 Pratt ..... A41D 19/01547 2/159

(Continued)

*Primary Examiner* — Tejash Patel
(74) *Attorney, Agent, or Firm* — Thomas Hamill; Robert M. Schwartz

(57) ABSTRACT

A glove having a pinky finger, ring finger, middle finger, index finger and thumb receiving portion in communication with a hand receiving portion is provided. The pinky finger, ring finger, middle finger, and index finger receiving portions of the glove each have a top panel and a bottom panel which are connected to form each of the finger receiving portions. An intermediate region and a distal region of the ring finger and middle finger receiving portions of the glove includes a first and second insert affixed to both the inner and outer sides of each. The intermediate region and a distal region of the pinky and index finger receiving portions of the glove include a first and second insert affixed to only the inner sides of each. The outer side of both the pinky and index finger receiving portions have no inserts provided. The thumb receiving portion have no inserts.

7 Claims, 8 Drawing Sheets

(56) References Cited

U.S. PATENT DOCUMENTS

| | | | | |
|---|---|---|---|---|
| 5,987,646 | A * | 11/1999 | Bolmer | A41D 19/01523 2/16 |
| 6,154,885 | A | 12/2000 | Kobayashi et al. | |
| 6,279,166 | B1 | 8/2001 | Schild | |
| 6,415,443 | B1 * | 7/2002 | Schierenbeck | A41D 19/01529 2/159 |
| 6,427,249 | B1 | 8/2002 | Mattesky | |
| 6,651,255 | B1 | 11/2003 | Schild | |
| 7,062,791 | B2 | 6/2006 | Gold | |
| 2006/0212990 | A1 | 9/2006 | Mattesky | |
| 2013/0061369 | A1 | 3/2013 | Lim | |
| 2014/0026281 | A1 * | 1/2014 | Kleinert | A41D 19/00 2/20 |

* cited by examiner

Figure 7A
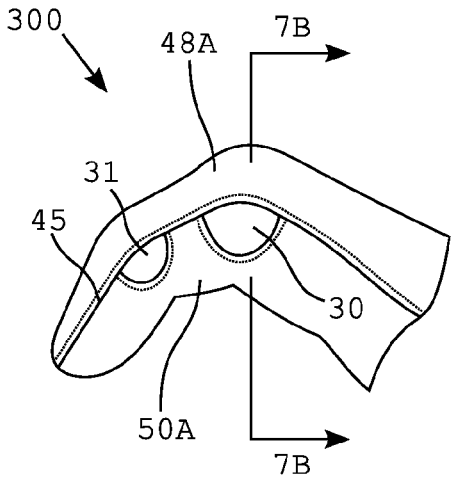
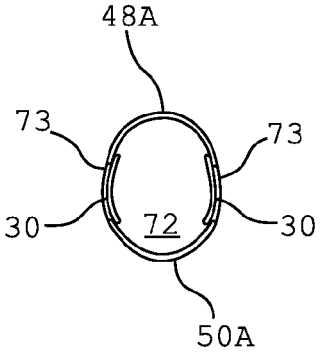
Figure 7B
Figure 7C
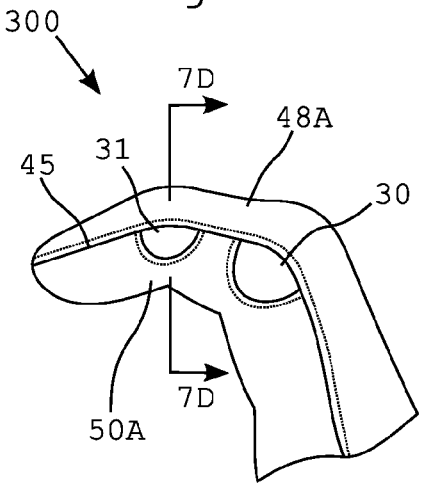
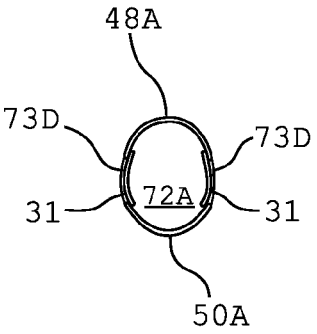
Figure 7D

GLOVES WITH SELECTIVE INSERTS ABOUT THE PROXIMAL AND DISTAL INTERPHALANGEAL JOINTS OF THE HAND

BACKGROUND OF THE INVENTION

The present invention relates generally to leather gloves, and more particularly, to a leather glove with inserts located about both sides of the middle knuckle portion or proximal interphalangeal joint of the middle two of the four fingers, and only one insert located on the interior side of the other two fingers again about the proximal interphalangeal joint. In addition, further inserts would be located about both sides of the distal interphalangeal joint of the middle two of the four fingers, and again only one insert located on the interior side of the other two fingers about the distal interphangeal joint. The inserts are adapted to effect the ease of bending the fingers within the glove. The thumb, although a digit, is not considered a finger for this discussion, and the thumb receiving portion does not have an insert provided on either side.

FIELD OF THE INVENTION

The applicant's previous U.S. Pat. No. 6,279,166 (which is incorporated by reference) includes a pair of inserts about each finger receiving portion of all four fingers on both hands (but not on the thumb). It has been found that the exterior insert on the pinky finger and the index finger often becomes detached due to failure of the stitching. This is the portion of the glove which arguably receives the most abuse, friction, rubbing and damage. The stitching fails and the exterior insert begins to unravel, eventually coming off completely. It has been found that by removing the insert on the exterior side of the pinky finger and index finger receiving portion and replacing it with a solid piece of leather, that the problem is solved and the glove still retains the ability to tighten the glove with ease and amplifies the life expectancy of the glove.

A second patent by the applicant, U.S. Pat. No. 6,651,255 which removed the exterior pinky insert solved this problem.

It has been found that the addition of inserts about the distal interphalangeal joints as described above gives greater flexibility. Additionally, the distal inserts adds curve in knuckle regions in all finger mechanically when the palm side is attached to the backside regions. It further adds extra curve in a protruding fashion to match the knuckle protrusion, on the backside portion of the hand and in all fingers when in closed position eliminating stretching of the leather or other glove material when the hand is closed. This has the additional effect of relieving stress of the muscles used in hand closure.

The addition of the distal inserts as described further keeps a natural straight line of fingers on the palm side while adding a closure curve to the finger areas. By extending the length on the backside of the hand, and isolating length extension only to the knuckle regions (both proximal and distal) and employing equal length extensions on both side panels this forces the folds on the inside of the finger portion of the glove to match folds on the fingers while in closed position.

A further benefit of the improved glove insert system is that they mechanically force the glove to be in a greatly improved closed position by adding length to the backside of the hand region, while shortening the length of the palm side region with respect to the backside region.

SUMMARY OF THE INVENTION

A glove having a pinky finger, ring finger, middle finger, index finger and thumb receiving portion in communication with a hand receiving portion is provided. The pinky finger, ring finger, middle finger and index finger receiving portions each have a top panel and a bottom panel, which are connected to form each of the finger receiving portions. Each finger receiving portion includes a distal region, an intermediate region, and a proximal region, the proximal region connected to the hand receiving portion, the distal region surrounding the distal interphalangeal joint and the intermediate region residing about the middle knuckle (proximal interphalangeal joint) of the hand. The proximal interphalangeal joint and the distal interphalangeal joint of each finger has an exterior and interior side (or right and left side).

With respect to the middle finger, the exterior side and the interior side are interchangeable. With respect to the pinky finger and the ring finger, the interior side is that side closest to the middle finger and the exterior side is that side closest to the outside of the hand. With respect to the index finger, the interior side is that side closest to the middle finger and the exterior side is that side closest to the outside of the hand or the thumb. These relationships are the same for both the right and the left gloves.

The intermediate region of two of the finger receiving portions (the ring finger and middle finger) includes a first and second insert. The first and second insert are provided on both the interior and exterior sides (both right and left sides).

The intermediate region of the other two finger receiving portions (the pinky and index finger) include only a first and second insert located on one side of each finger. This would be on the interior side. The thumb portion of the glove has no inserts.

The first insert is located on the interior side of the proximal interphalangeal joint. The exterior side (or outer side) of the pinky finger and the exterior side (or outer side) of the index finger opposite the first insert receiving portions are a solid piece of leather.

The second insert is located on the interior side of the distal interphalangeal joint. The exterior side (or outer side) of the pinky finger and the exterior side (or outer side) of the index finger opposite the second insert receiving portions are a solid piece of leather.

When constructing the glove portions of the index finger and pinky finger, the side which is not adapted to receive the first insert and second insert is provided with extra material. This permits the index finger and pinky finger portions of the glove to be symmetric once the flexor inserts are affixed.

Again, both the first and second inserts are generally of a triangular shape and provided directly or proximal the bottom panel. The inserts are sewn in the bottom panel after the bottom panel has, been rotated to approximate the bending of the proximal interphalangeal joint and the distal interphalangeal joint of the finger.

The pinky and index finger receiving portions are again only to have a first and second insert which are adapted to be received on the side of the finger closest to the adjacent finger. The pinky finger and index finger receiving portions which do not reside next to a finger does not have a pair of inserts, as the other two fingers do.

It has been found if an insert was provided in these regions, that the stitching would fail and the glove would tear apart. By keeping the side of the finger receiving portions which intersect with the environment a solid piece of leather, the glove lasts longer and has greater comfort of wear. This permits the wearer to close his hand about an object without stretching the glove intermediate regions. This permits the wearer to tighten his grip with greater ease and increases the life expectancy of the glove.

BRIEF DESCRIPTION OF THE DRAWINGS

The invention will be better understood and the above objects as well as objects other than those set forth above will be more apparent after a study of the following detailed description thereof. Such description makes reference to the annexed drawings wherein:

FIG. 7A is a side view of the portion of the glove adapted to receive the ring or middle finger showing the the pair of inserts affixed to a first side.

FIG. 7B is a cross-sectional view of the glove adapted to receive the ring or middle finger taken along line 7B-7B (about the proximal interphalangeal joint) of FIG. 7A.

FIG. 7C is a side view of the portion of the glove adapted to receive the ring or middle finger showing the the pair of inserts affixed to a first side.

FIG. 7D is a cross-sectional view of the glove adapted to receive the ring or middle finger taken along line 7D-7D about the distal interphalangeal joint of FIG. 7A.

DETAILED DESCRIPTION OF THE FIGURES

With reference now to the drawings, a glove with inserts on the finger portions embodying the principles and concepts of the present invention will be described. Such gloves may be comprised of leather for outdoor use. Other applications would include the glove being comprised of special materials for firefighting, scuba or deep sea diving, and aerospace use. Gloves having the selected inserts may be used in golfing, motorcycling, bicycling, gardening, farming, animal husbandry, as well as for cold weather. The gloves having selected inserts may be employed anywhere an ordinary glove may be employed.

The term proximal interphalangeal joint is interchangeable with it's initials PIJ and the term distal interphalangeal joint is interchangeable with it's initials DIJ. The terms index finger, middle finger, ring finger, and pinky finger are contextually equivalent to the terms index finger receiving portion, middle finger receiving portion, ring finger receiving portion and pinky finger receiving portion.

Figure 1:
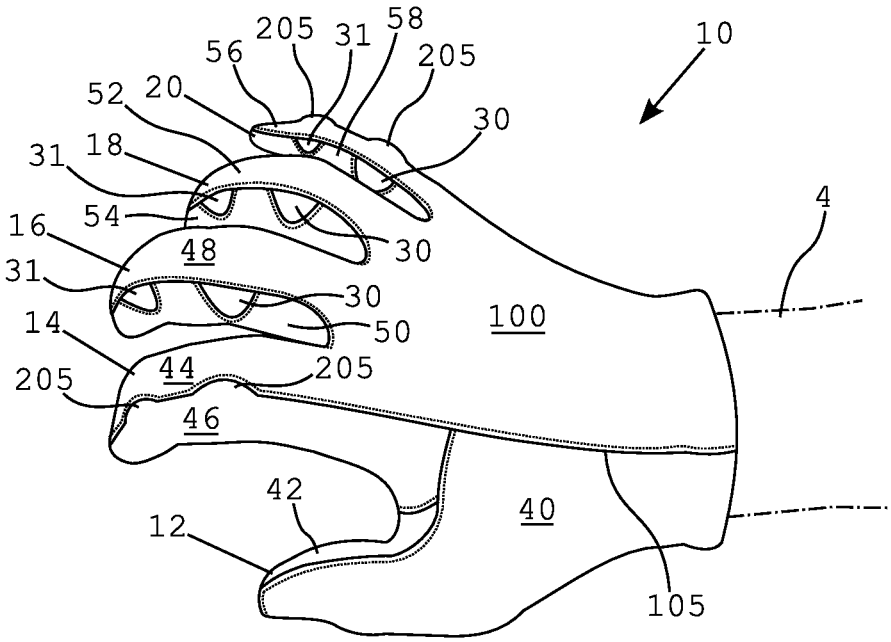
FIG. 1 is a view of the glove with selective inserts, the glove being worn on the hand.
Figure 2:
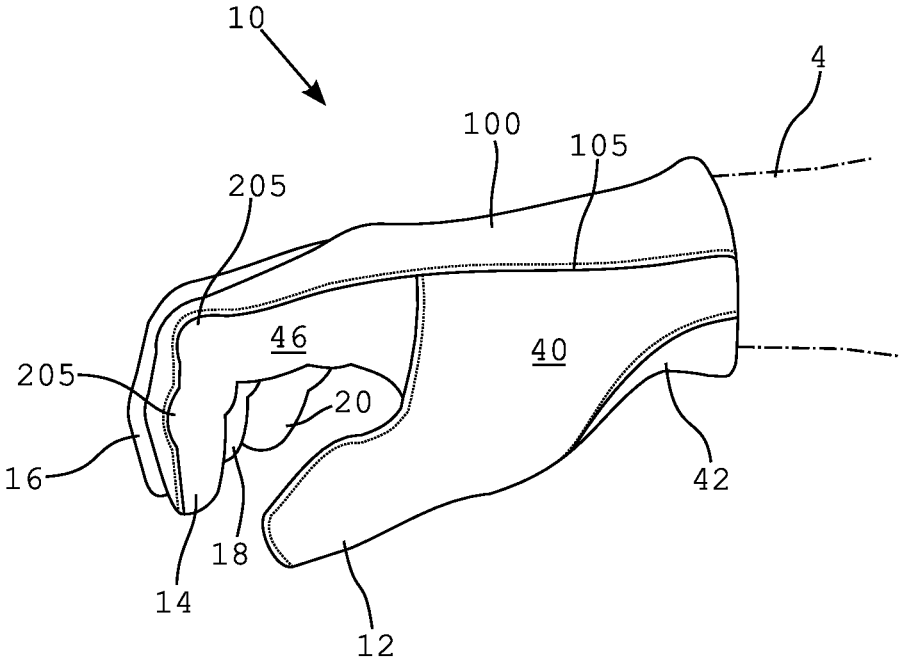
FIG. 2 is a side view of the glove with selective inserts, the glove being worn on the hand.
Figure 10:
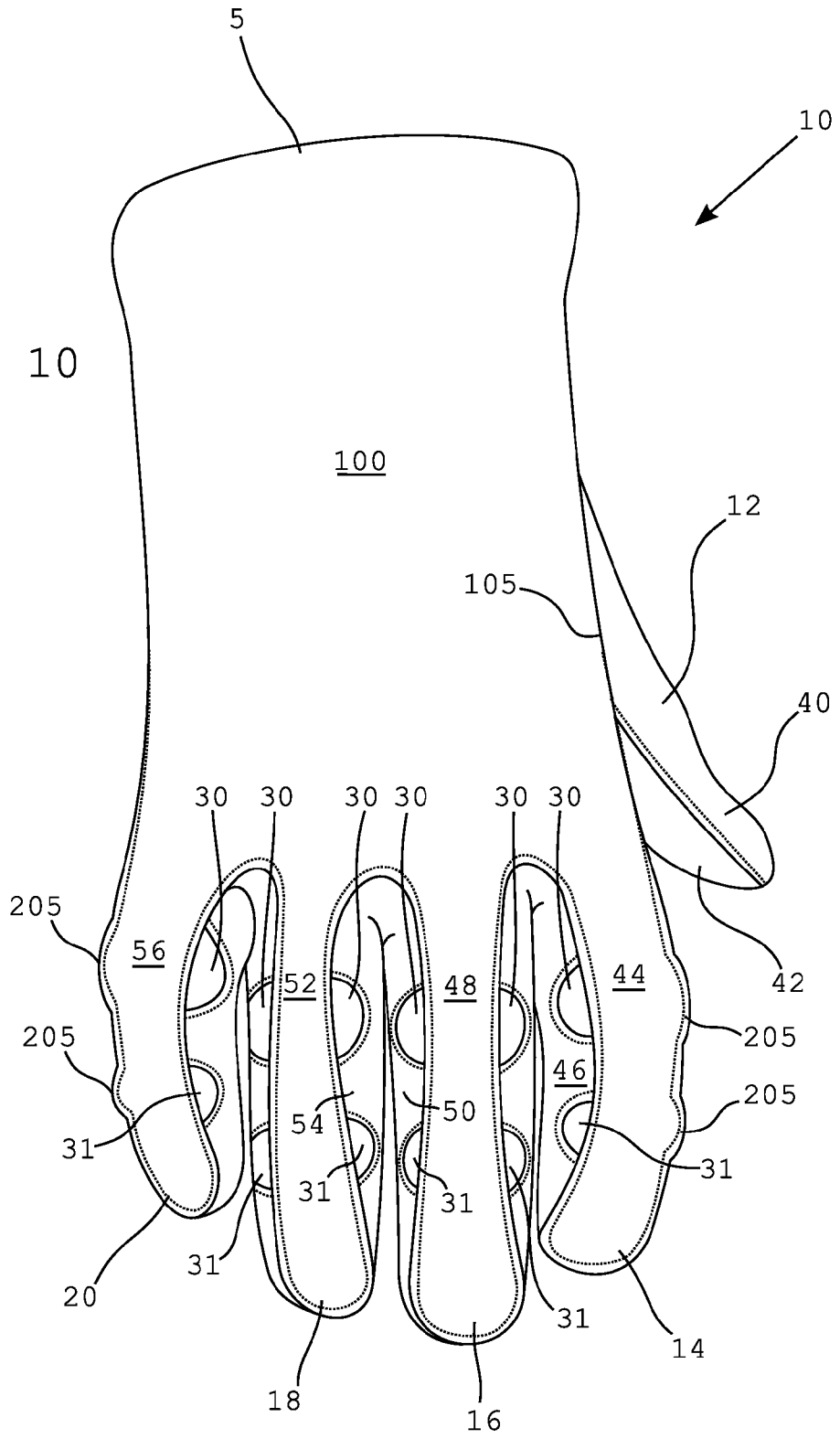
FIG. 10 is a top view of the glove with specialized and selective inserts.

Turning initially to FIGS. 1, 2 and 10, there is shown the glove with PIJ inserts 30 and DIJ inserts 31 on the finger portions of the glove 10. In its preferred form, glove 10 comprises generally a hand receiving portion 100, a thumb receiving portion 12, an index finger (or forefinger) receiving portion 14, a middle finger receiving portion 16, a ring finger receiving portion 18 and a pinky (or small) finger receiving portion 20. The glove 10 includes an opening 5 proximal the wrist 4.

The thumb receiving portion 12 includes a top panel 40 and a bottom panel 42. The thumb receiving portion top panel 40 and bottom panel 42 are sewn together and are connected to the hand receiving portion 100 about sew line 105. The thumb receiving portion 12 does not include any inserts.

The index finger receiving portion 14 includes a top panel 44 and a bottom panel 46. A PIJ flexor insert 30 is provided on the side of the index finger 14 closest to the middle finger 16. The flexor insert 30 is sewn to the bottom panel 46 about or near the PIJ of the index finger 14.

A DIJ flexor insert 31 is provided on the inner side of the index finger 14 which is closest to the middle finger 16. The flexor insert 31 is sewn to the bottom panel 46 about or near the DIJ of the index finger 14.

There is are no inserts (30,31) located on the side of the index finger 14 closest to the thumb receiving portion 12. It has been found if inserts (30,31) were provided on the side of the index finger receiving portion 14 closest to the thumb receiving portion 12, that the insert stitching would fail and the glove 10 would form an unwanted opening or tear. By keeping the outer side of the index finger receiving portion 14 nearest to the thumb portion 12 as a solid piece of leather, it has been found that the glove 10 lasts longer and has greater comfort of wear. This permits the wearer to close his hand about an object without stretching the glove 10. This permits the wearer to tighten his grip with greater ease and increases the life expectancy of the glove 10.

The middle finger receiving portion 16 includes a top panel 48 and a bottom panel 50. A PIJ flexor insert 30 is provided on the side of the middle finger 16 closest to the index finger 14. The flexor insert 30 is sewn to the bottom panel 50 about or near the PIJ of the index finger 14. X A DIJ flexor insert 31 is also provided on the side of the middle finger 16 closest to the index finger 14. The flexor insert 31 is sewn to the bottom panel 50 about or near the DIJ of the middle finger 16.

A PIJ flexor insert 30 is provided on the side of the middle finger 16 closest to the ring finger 18. The flexor insert 30 is sewn to the bottom panel 50 about or near the PIJ of middle finger 16.

A DIJ flexor insert 31 is also provided on the side of the middle finger 16 closest to the ring finger 18. The flexor insert 31 is sewn to the bottom panel 50 about or near the DIJ of middle finger 16.

The ring finger receiving portion 18 includes a top panel 52 and a bottom panel 54. A PIJ flexor insert 30 is provided on the side of the ring finger 18 closest to the middle finger 16. The flexor insert 30 is sewn to the bottom panel 54 about or near the PIJ of the ring finger 18.

A DIJ flexor insert 31 is also provided on the side of the ring finger 18 closest to the middle finger 16. The flexor insert 31 is sewn to the bottom panel 50 about or near the DIJ of middle finger 16.

A PIJ flexor insert 30 is provided on the side of the ring finger 18 closest to the pinky finger 20. The flexor insert 30 is sewn to the bottom panel 54 about or near the PIJ of the ring finger 18.

A DIJ flexor insert 31 is also provided on the side of the ring finger 18 closest to the pinky finger 20. The flexor insert 31 is sewn to the bottom panel 50 about or near the DIJ of ring finger 20.

Both the middle finger 16 and the ring finger 20 have PIJ inserts 30 and DIJ 31 inserts on both sides of the middle finger 16 and the ring finger 20.

The pinky finger receiving portion 20 includes a top panel 56 and a bottom panel 58. A flexor insert 30 is provided on the side of the pinky finger receiving portion 20 closest to the ring finger receiving portion 18. The flexor insert 30 is sewn to the bottom panel 58 about or near the PIJ of the pinky finger 20.

A DIJ flexor insert 31 is also provided on the side of the pinky finger 20 closest to the ring finger 18. The flexor insert 31 is sewn to the bottom panel 58 about or near the DIJ of pinky finger 20.

There are no flexor inserts (30, 31) located on the side of the pinky receiving portion which resides next to the environment. It has been found that if the inserts (30, 31) were provided on the side of the pinky receiving portion 20 closest to the environment, that the stitching would fail and the glove 10 would tear and be damaged. By keeping the side of the pinky finger receiving portion 20 which intersects with the environment as a solid piece of leather, the glove 10 lasts longer and has greater comfort of wear. This permits the wearer to tighten his grip with greater ease and increases the life expectancy of the glove 10.

Referring now specifically to FIGS. 3, 3A, 3B, and 3C, a section of the index finger receiving portion 14 is shown as well as the manner of attachment of the PIJ flexor element 230 and the DIJ flexor element 231.

Figure 3:
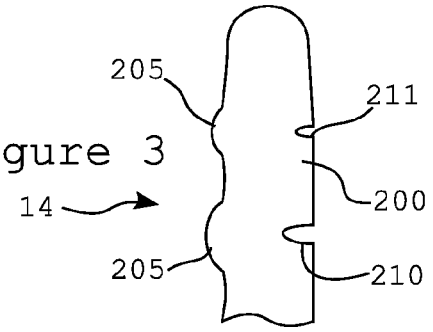
FIG. 3 is a view of the pattern used for the bottom panel of the glove adapted to receive the index finger of the hand, including the apertures designed to receive the pair of inserts.

FIG. 3 includes a bottom portion 200 of the index finger receiving portion 14, prior to the flexor insert 230 being affixed. A first cut 210 is made in the bottom portion 200 near or about the PIJ. A second smaller cut 211 is made in the bottom portion 200 near or about the DIJ. Portion or hump 205 is generally arcuate as extra material is provided opposite the cuts (210, 211). This extra material at 205 permits the bottom portion 200 to be symmetrical as shown in FIG. 3B when the flexor inserts (230, 231) are affixed.

Humps (205, 205A) provide the same arc as when flexor insert (230, 231) on the opposite side of the index finger 14 and pinky finger 20. The humps (205, 205A) further keeps one solid line of stitching on outside portion of index finger 14 and pinky finger 20. Humps (205, 205A) keeps the material comprising the index finger 14 and pinky finger 20 straight so that folds in glove material match the same angle as fold on the inside of the index finger 14 and pinky finger 20 in closed position. The humps 205 mechanically forces fingers into grip closure position when palm side of glove is sewn to back side of glove without distorting index fingers 14 and pinky fingers 20 during natural closure motion. Humps (205, 205A) also create arcing in glove over natural arcing of PIJ and DIJ in closed hand position without stretching of any of the glove material. The humps (205, 205A) are different sizes depending if they are used near or about the PIJ or the DIJ. The size of the hump (205, 205A) near or about the PIJ is larger than that of DIJ. The size of the insert 230 near or about the PIJ is larger than the insert 231 used near or about the DIJ.

Figure 3A:
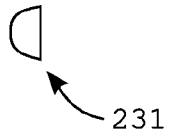
FIG. 3A is a view of the flexor insert for the glove about the distal interphalangeal joint of the index finger.
Figure 3B:
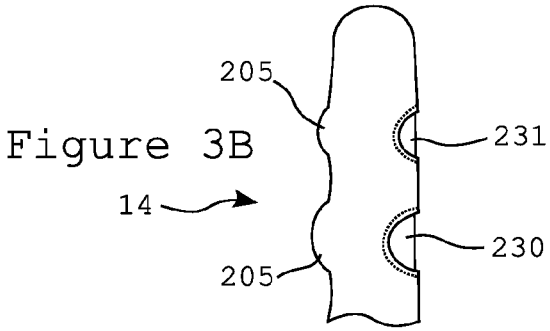
FIG. 3B is a a view of the index finger with the flexor inserts affixed.

FIG. 3A shows the flexure insert 231. Flexure insert 231 is affixed in cut 211 by sewing or other equivalent affixation method as shown in FIG. 3B.

Figure 3C:
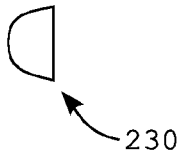
FIG. 3C is a view of the flexor insert for the glove about the proximal interphalangeal joint of the index finger.

FIG. 3C shows the flexure insert 230. Flexure insert 230 is affixed in cut 210 by sewing or other equivalent affixation method as shown in FIG. 3B.

The index finger receiving portion 14 is shown for the right hand in FIG. 3 and FIG. 3B. The index finger receiving portion 14 for the left hand would be the mirror image of FIG. 3 and FIG. 3B.

Figure 4:
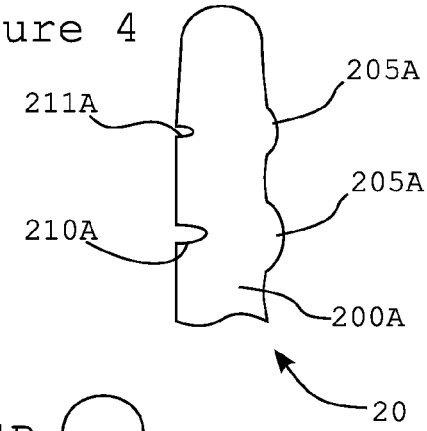
FIG. 4 is a view of the pattern used for the bottom panel of the glove adapted to receive the pinky finger of the hand, including the apertures designed to receive the pair of inserts.
Figure 4A:
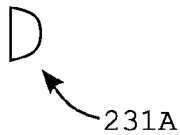
FIG. 4A is a view of the flexor insert for the glove about the distal interphalangeal joint of the pinky finger.
Figure 4B:
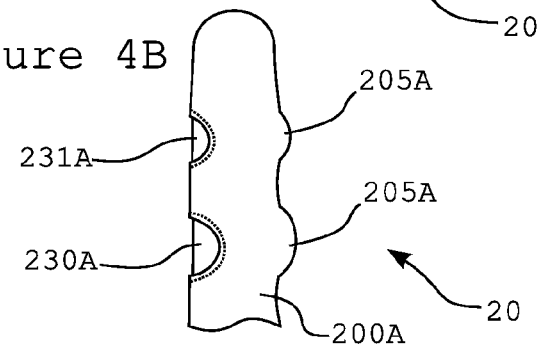
FIG. 4B is a a view of the pinky finger with the flexor inserts affixed.

Referring now specifically to FIGS. 4, 4A & 4B, a section of the pinky finger receiving portion 20 is shown as well as the manner of attachment of the PIJ flexor element 230A and the DIJ flexor element 231A.

FIG. 4 includes a bottom portion 200A of the pinky finger receiving portion 20, prior to the flexor insert 230A being affixed. A first cut 210A is made in the bottom portion 200A near or about the PIJ. A second smaller cut 211A is made in the bottom portion 200A near or about the DIJ. Portion or hump 205A is generally arcuate as extra material is provided opposite the cuts (210A, 211A). This extra material at 205A permits the bottom portion 200A to be symmetrical as shown in FIG. 4B when the flexor inserts (230A, 231A) are affixed. XXX FIG. 4A shows the flexure insert 231A. Flexure insert 231A is affixed in cut 211A by sewing or other equivalent affixation method as shown in FIG. 4B.

Figure 4C:
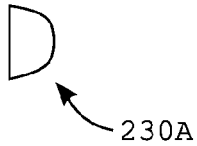
FIG. 4C is a view of the flexor insert for the glove about the proximal interphalangeal joint of the pinky finger.

FIG. 4C shows the flexure insert 230A. Flexure insert 230A is affixed in cut 210A by sewing or other equivalent affixation method as shown in FIG. 4B.

The pinky finger receiving portion 20 is shown for the right hand in FIG. 4 and FIG. 4B. The pinky finger receiving portion 20 for the left hand would be the mirror image of FIG. 4 and FIG. 4B.

Figure 5:
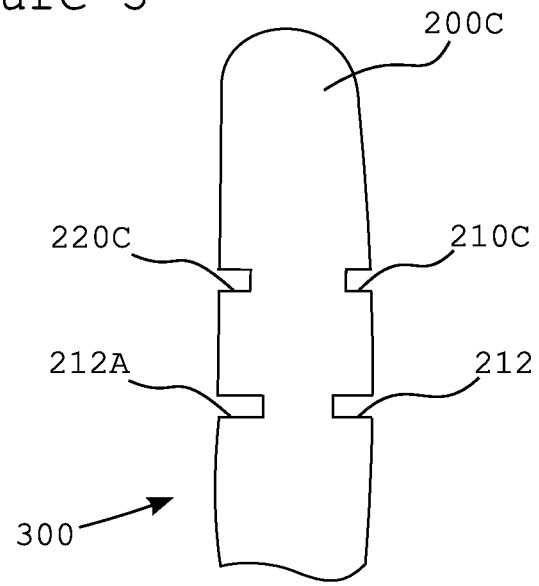
FIG. 5 is a view of the pattern used for the bottom panel of the glove adapted to receive either the ring finger and/or the middle finger, including the apertures designed to receive the inserts.
Figure 5A:
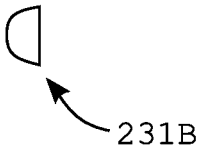
FIG. 5A is a view of the flexor insert for the glove about the distal interphalangeal joint of the ring finger and/or middle finger.
Figure 5B:
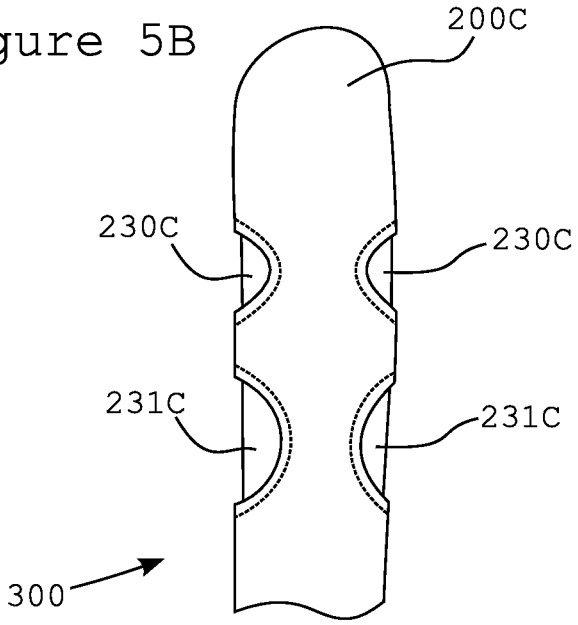
FIG. 5B is a view of the ring finger and/or the middle finger with a pair of flexor inserts affixed to both sides of of the ring finger and/or the middle finger portion of the glove.

Turning now to FIGS. 5, 5A, & 5B the manner of attachment of the flexor element in the glove portion provided for the ring finger 18 and middle finger 16 of both hands is shown.

FIG. 5 shows a bottom portion 200C of either the ring or middle finger receiving portions 300, prior to the flexor inserts (230C, 230C) being affixed. A first right cut 210C and a first left cut 220C are made about the DIJ of both sides of either the ring or middle finger receiving portion 300. A second right cut 212 and a second left cut 212A are made about the PIJ of both sides of either the ring or middle finger receiving portion 300.

The first right cut 210C and a first left cut 220C are smaller than the second right cut 212 and a second left cut 212A.

FIG. 5A shows the flexure insert 230C. Flexure insert 230C is affixed in the first right cut 210C and the first left cut 220C by sewing or other equivalent affixation method as shown in FIG. 5B.

Figure 5C:
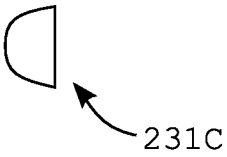
FIG. 5C is a view of the flexor insert for the glove about the proximal interphalangeal joint of the ring finger and/or middle finger.

FIG. 5C shows the flexure insert 231C. Flexure insert 231C is affixed in second right cut 212 and a second left cut 212A by sewing or other equivalent affixation method as shown in FIG. 5B.

The dashed lines in FIG. 5B are sticking. Other means of attachment of the insert to the cut adapted to receive the insert may be provided.

Figure 6A:
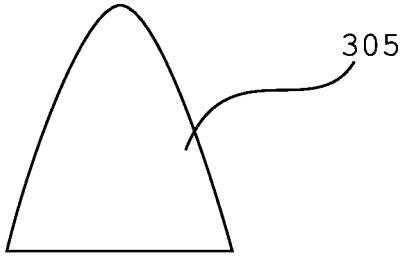
FIG. 6A shows a view of the flexor insert of a generally sinusoidal configuration.
Figure 6B:
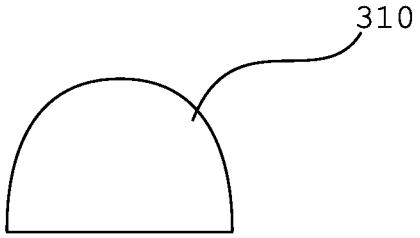
FIG. 6B shows a view of the flexor insert in a generally half-circular configuration.
Figure 6C:
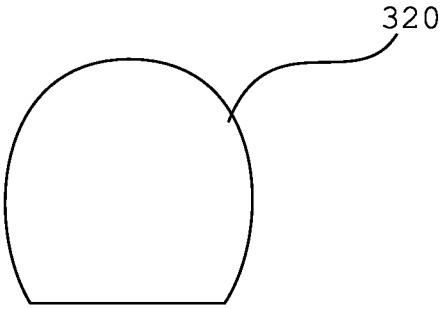
FIG. 6C shows a view of the flexor insert in a generally scalloped configuration.

Referring now to specifically to FIGS. 6A, 6B, and 6C variations of the flexor insert are shown. FIG. 6A discloses a sinusoidal insert 305. FIG. 6B discloses a half-circle insert 310. FIG. 6C discloses a scalloped insert 320. The flexor insert may have configurations including, but not limited to, a half-circle, a sinusoidal portion, a rectangular element, a half-hexagonal element, a half octagonal element, a scalloped portion etc. In one embodiment, the flexor inserts (230, 231) has a generally similar appearance to that shown in FIG. 3A. It is to be understood that other flexor insert configurations may be desirable for different types of gloves.

FIG. 7A shows the either the ring or middle finger receiving portions 300, including the top panel 48A and the bottom panel 50A. The PIJ insert 30 is shown sewn on the side of the bottom panel 50A. The DIJ insert 31 is shown sewn on the side of the bottom panel 50A. Bottom panel 50A including the inserts (30,31) are sewn to the top panel 48 along line 45 forming the ring or middle finger receiving portions 300. The ring or middle finger receiving portions 300 assembly is identical for both the right and left sides of the middle finger receiving portion 16 and except for dimension, for the ring finger receiving portion 18 as well. This structure is the same for both the glove which would be placed on both the right and the left hand.

FIG. 7B is a cut-away view taken along line 7B-7B of FIG. 7A. The PIJ portion 72 of the top panel 48A of the bottom panel 50A is shown. PIJ insert 30 is shown connected on both the right and left sides of the bottom panel 50A. Element 73 on the right and left side are merely material located behind the PIJ insert 30, in communication with the bottom panel 50A.

FIG. 7C shows the either the ring or middle finger receiving portions 300, including the top panel 48A and the bottom panel 50A. The PIJ insert 30 is shown sewn on the side of the bottom panel 50A. The DIJ insert 31 is shown sewn on the side of the bottom panel 50A. Bottom panel 50A including the inserts (30,31) are sewn to the top panel 48 along line 45 forming the ring or middle finger receiving portions 300.

FIG. 7D is a cut-away view taken along line 7D-7D of FIG. 7C. The DIJ portion 72A of the top panel 48A of the bottom panel 50A is shown. DIJ insert 31 is shown connected on both the right and left sides of the bottom panel 50A. Element 73 on the right and left side are merely material located behind the DIJ insert 31, in communication with the bottom panel 50A.

Figure 8A:
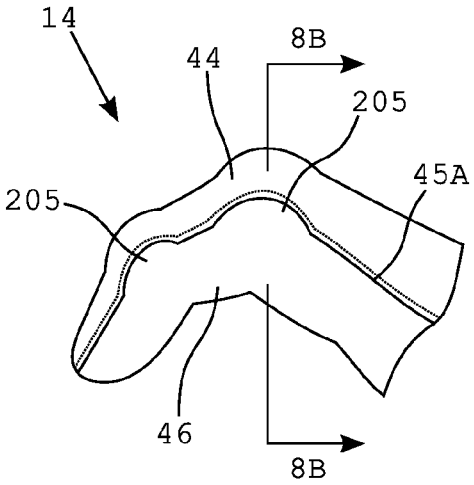
FIG. 8A is a side view of the portion of the glove adapted to receive the index finger showing the outer side, the outer side not having the insert.
Figure 8B:
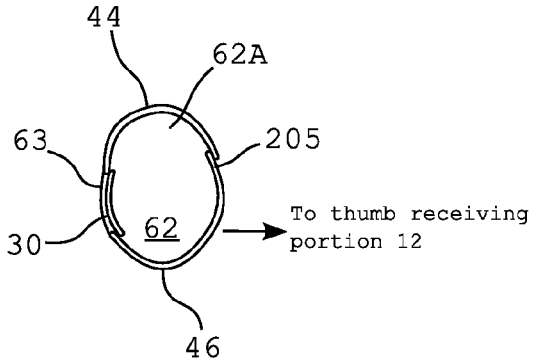
FIG. 8B is a cross-sectional view of the portion of the glove adapted to receive the index finger taken along line 8B-8B about the proximal interphalangeal joint of FIG. 8A.

FIG. 8A is a side view of the index finger receiving portion 14 closest to the thumb receiving portion 12 of the glove. There are no flexor inserts (30, 31) on the side of the outer side of the index finger receiving portion 14 closest to the thumb 12. Rather, the flexor inserts (30,31) are on the index finger receiving portion 14 closest to the middle finger 16 and is best seen in FIG. 8B. Bottom panel 46 is sewn to the top panel 44 along line 45A forming the index finger receiving portion 14.

FIG. 8B is a cut-away view taken along line 8B-8B of FIG. 8A. The PIJ portion 62A of the top panel 44 and the PIJ portion 62 of the bottom panel 46 are shown. PIJ insert 30 is shown connected on the inner side of the bottom panel 46 closest to the middle finger 16. Element 63 is glove material behind the PIJ insert 30.

Figure 8C:
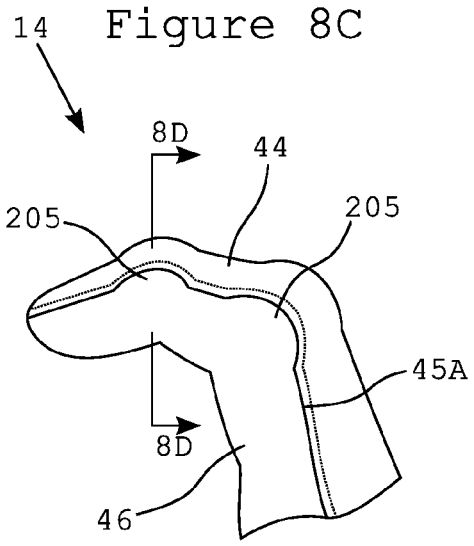
FIG. 8C is a side view of the portion of the glove adapted to receive the index finger showing the outer side, the outer side not having the insert.

FIG. 8C is a side view of the index finger receiving portion 14 closest to the thumb receiving portion 12. As can be clearly seen, there is no flexor insert (30, 31) on the side of the outer side of the index finger receiving portion 14 closest to the thumb 12. Rather, the flexor inserts (30,31) is on the index finger receiving portion 14 closest to the middle finger 16 as best seen in FIG. 8B. Bottom panel 46 is sewn to the top panel 44 along line 45A forming the index finger receiving portion 14.

Figure 8D:
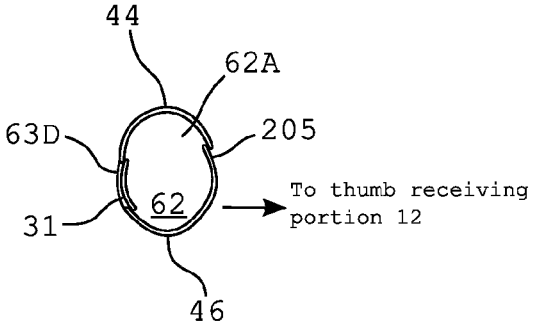
FIG. 8D is a cross-sectional view of the portion of the glove adapted to receive the index finger taken along line 8D-8D about the distal interphalangeal joint of FIG. 8C.

FIG. 8D is a cut-away view taken along line 8D-8D of FIG. 8C. The DIJ insert 31 is shown on the inner side of the bottom panel 46 closest to the middle finger 16. Element 63D is glove material behind the DIJ insert 31.

Figure 9A:
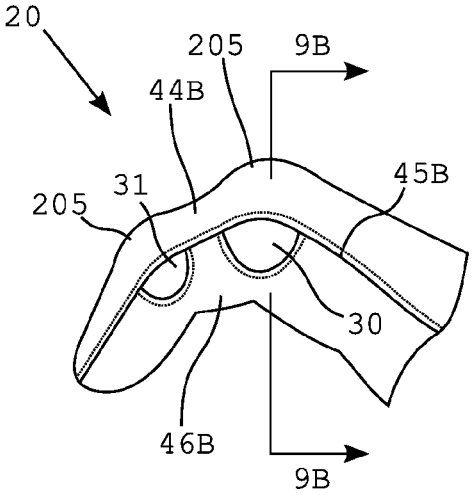
FIG. 9A is a side view of the portion of the glove adapted to receive the pinky finger showing the inner side, the inner side having a pair of inserts, the inner side being adjacent to the ring finger.

Referring now to FIG. 9A, a side view of the pinky finger receiving portion 20 closest the ring finger receiving portion 18 is shown. Flexor inserts (30, 31) are attached to the inner side of the pinky finger receiving portion 20. There are no flexor inserts on the outer side of the pinky finger 20. Bottom panel 46B is sewn to the top panel 44B along line 45B forming the pinky finger receiving portion 20.

Figure 9B:
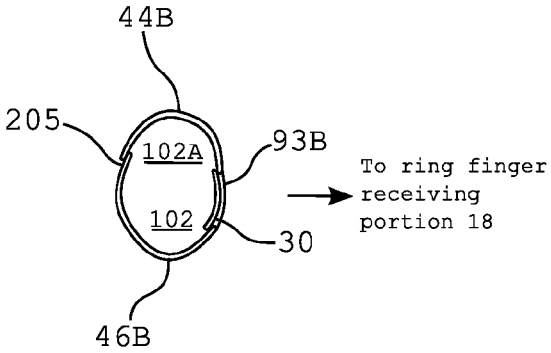
FIG. 9B is a is a cross-sectional view of the portion of the glove adapted to receive the pinky finger taken along line 9B-9B about the proximal interphalangeal joint of FIG. 9A.

FIG. 9B is a cut-away view taken along line 9B-9B of FIG. 9A. The PIJ portion 102A of the top panel 44B and the PIJ portion 102 of the bottom panel 46B are shown. PIJ insert 30 is shown connected on the inner side of the bottom panel 46 closest to the ring finger 18. Element 93B is glove material behind the PIJ insert 30.

Figure 9C:
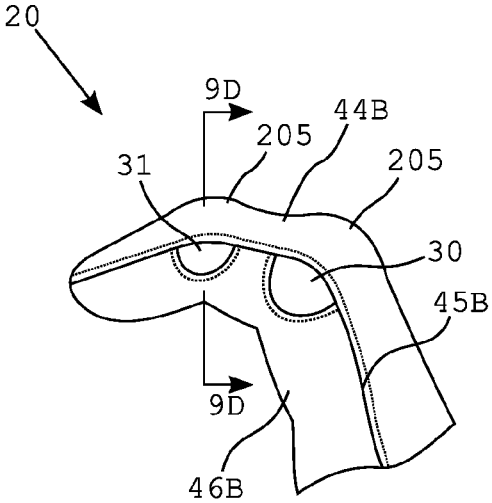
FIG. 9C is a side view of the portion of the glove adapted to receive the pinky finger showing the inner side, the inner side having a pair of inserts, the inner side being adjacent to the ring finger.

Referring now to FIG. 9C, a side view of the pinky finger receiving portion 20 closest the ring finger receiving portion 18 is shown. Flexor inserts (30, 31) are attached to the inner side of the pinky finger receiving portion 20. There are no flexor inserts on the outer side of the pinky finger 20. Bottom panel 46B is sewn to the top panel 44B along line 45B forming the pinky finger receiving portion 20.

Figure 9D:
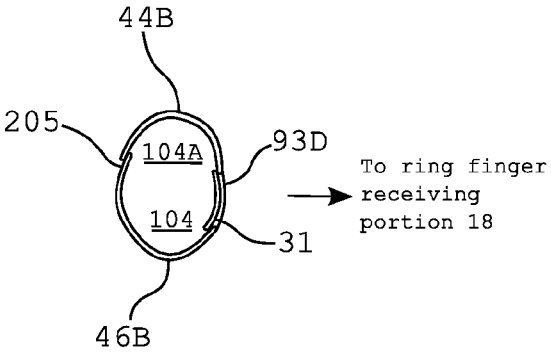
FIG. 9D is a is a cross-sectional view of the portion of the glove adapted to receive the pinky finger taken along line 9D-9D about the distal interphalangeal joint of FIG. 9C.

FIG. 9D is a cut-away view taken along line 9D-9D of FIG. 9C. The DIJ portion 104A of the top panel 44B and the PIJ portion 104B of the bottom panel 46B are shown. DIJ insert 31 is shown connected on the inner side of the bottom panel 46B closest to the ring finger 18. Element 93D is glove material behind the DIJ insert 31.

The instant gloves and inserts may be manufactured from any of a wide variety of materials. These include, but are not limited to, cowhide, leathers, deer skin, goat hide, elk hide, fabrics and the like. Fireproof materials may be employed. Further, insulation may be provided inside the glove as is well known in the art.

The instant gloves may be further treated to enhance their resistance to water, to alter their heat transfer characteristics, and to reduce their susceptibility to wear. Coloring agents may also be employed to alter the color.

With respect to the above description, it should be realized that the optimum dimensional relationships for the parts of the invention, to include variations in size, materials, shape, form, function and manner of operation, assembly and use, are deemed readily apparent and obvious to those skilled in the art, and therefore, all relationships equivalent to those illustrated in the drawings and described in the specification are intended to be encompassed only by the scope of appended claims.

While the present invention has been shown in the drawings and fully described above with particularity and detail in connection with what is presently deemed to be the most practical and preferred embodiments of the invention, it will be apparent to those of ordinary skill in the art that many modifications thereof may be made without departing from the principles and concepts set forth herein. Hence, the proper scope of the present invention should be determined only by the broadest interpretation of the appended claims so as to encompass all such modifications and equivalents.

The invention claimed is:

1. A glove for covering the right hand, said glove having a thumb receiving portion, an index finger receiving portion, a middle finger receiving portion, a ring finger receiving portion and a pinky receiving portion, said index receiving portion having a top panel and a bottom panel, said middle finger receiving portion having a top panel and a bottom panel, said ring finger having a top panel and a bottom panel, said pinky finger having a top panel and a bottom panel, said index finger bottom portion having an intermediate region, said middle finger bottom portion having an intermediate region, said ring finger bottom portion having an intermediate region, said pinky finger bottom portion having an intermediate region, said index finger bottom portion having a distal region, said middle finger having a distal region, said ring finger having a distal region, said pinky finger having a distal region, said index finger bottom portion intermediate region and distal region having a right and a left side, said middle finger bottom portion intermediate region and distal region having a right and a left side, said ring finger bottom portion intermediate region and distal finger having a right and a left side, said pinky finger bottom portion intermediate region and distal region having a right and a left side, said index finger bottom portion intermediate region and said distal region including an intermediate region first insert and a distal region second insert, both said intermediate region first insert and said distal region second insert located on said right side, said index finger bottom portion includes a first hump of extra glove material opposite said intermediate region first insert and a second hump of extra glove material opposite said distal region second insert and said third hump of extra glove material and said fourth hump of extra glove material located on said left side of said index finger, said middle finger bottom portion intermediate region right side including a first insert, said middle finger bottom portion distal region right side including a second insert, said middle finger bottom portion intermediate region left side including a first insert, said middle finger bottom portion distal region left side including a second insert, said ring finger bottom portion intermediate region right side including a first insert, said ring finger bottom portion distal region right side including a second insert, said ring finger bottom portion intermediate region left side including a first insert, said middle finger bottom portion distal region left side including a second insert, said pinky finger bottom portion intermediate region including a first insert, said first insert located on said left side, said pinky finger bottom portion distal region including a second insert, said pinky finger bottom portion includes a third hump of extra glove material opposite said first insert and a fourth hump of extra glove material opposite said second insert and said third hump of extra glove material and said fourth hump of extra glove material being located on said right side of said pinky finger, said index finger top panel connected to said index finger bottom panel, said middle finger top panel connected to said middle finger bottom panel, said ring finger top panel connected to said ring finger bottom panel, said pinky finger top panel connected to said pinky finger bottom panel, whereby said first hump of extra glove material keeps said index finger receiving portion straight, and said second hump of extra glove material keeps said pinky finger receiving portion straight.

2. A glove for covering the left hand, said glove having a thumb receiving portion, an index finger receiving portion, a middle finger receiving portion, a ring finger receiving portion and a pinky receiving portion, said index receiving portion having a top panel and a bottom panel, said middle finger receiving portion having a top panel and a bottom panel, said ring finger having a top panel and a bottom panel, said pinky finger having a top panel and a bottom panel, said index finger bottom portion having an intermediate region and a distal region, said middle finger bottom portion having an intermediate region and a distal region, said ring finger bottom portion having an intermediate region and a distal region, said pinky finger bottom portion having an intermediate region and a distal region, said index finger bottom portion intermediate region and distal region having a right and a left side, said middle finger bottom portion intermediate region and distal having a right and a left side, said ring finger bottom portion intermediate region and distal region having a right and a left side, said pinky finger bottom portion intermediate region and distal region having a right and a left side, said index finger bottom portion intermediate region including a first insert, said first insert located on said left side, said index finger bottom portion distal region including a second insert located on said left side, said index finger bottom portion includes a first hump of extra glove material opposite said intermediate region first insert and a second hump of extra glove material opposite said distal region second insert and said third hump of extra glove material and said fourth hump of extra glove material located on said right side of said index finger and no inserts located on said right side of said index finger, said middle finger bottom portion intermediate region right side including a first insert, said middle finger bottom portion distal region right side including a second insert, said middle finger bottom portion intermediate region left side including a first insert, said middle finger distal region left side including a second insert, said ring finger bottom portion intermediate region right side including a first insert, said ring finger bottom portion distal region right side including a second insert, said ring finger bottom portion intermediate region left side including a second insert, said pinky finger bottom portion intermediate region including a first insert, said first insert located on said right side, said pinky finger bottom portion distal region right side including a second insert, said pinky finger bottom portion includes a third hump of extra glove material opposite said first insert and a fourth hump of extra glove material opposite said second insert and said third hump of extra glove material and said fourth hump of extra glove material located on said left side of said pinky finger, said index finger top panel connected to said index finger bottom panel, said middle finger top panel connected to said middle finger bottom panel, said ring finger top panel connected to said ring finger bottom panel, said pinky finger top panel connected to said pinky finger bottom panel, whereby said first hump of extra glove material keeps said index finger receiving portion straight, and said second hump of extra glove material keeps said pinky finger receiving portion straight.

3. A glove for covering a hand including four fingers and a thumb, each of the four fingers having a middle knuckle portion located about the proximal interphalangeal joint of the hand, each of the four fingers having a distal knuckle portion located about the distal interphalangeal joint of the hand, said glove having a first finger receiving portion, said first finger receiving portion adjacent said thumb, said first finger receiving portion having a top side, a bottom side, a thumb side and an inner side, said bottom side said inner side including a first insert proximal the middle knuckle portion, and a second insert proximal the distal knuckle portion and a first hump of extra glove material opposite said first insert and a second hump of extra glove material opposite said second insert, said first hump of extra glove material located and said second hump of extra glove material located on said thumb side of said first finger, said glove further includes a second finger receiving portion, said second finger receiving portion having a top side, a bottom side, a right side and a left side, said bottom side including a pair of inserts proximal said middle knuckle portion on said bottom side left side and said bottom side right side, said bottom side including side further including a pair of inserts proximal said distal knuckle portion on said bottom side left side and said bottom side left side, said third finger receiving portion having a top side, a bottom side, a right side and a left side, said bottom side including a pair of inserts proximal said middle knuckle portion on said bottom side left side and said bottom side right side, said bottom side including side further including a pair of inserts proximal said distal knuckle portion on said bottom side left side and said bottom side left side, a fourth finger receiving portion, said fourth finger receiving portion having a top side, a bottom side, an air side and an inner side, said bottom side of said inner side including a first insert proximal the middle knuckle portion, and a second insert proximal the distal knuckle portion inner side, and a second insert proximal said distal knuckle portion inner side and a third hump of extra glove material opposite said first insert and a second hump of extra glove material opposite said second insert, said first hump of extra glove material located and said second hump of extra glove material located on said air side of said fourth finger, and no inserts located on said air side of said middle knuckle portion or on the air side of said distal knuckle portion of said fourth finger.

4. A glove having four finger receiving portions and a thumb receiving portion whereby a first of said four finger receiving portions is a pinky receiving portion, said pinky receiving portion has a bottom side and a top side, an inner side adjacent a second of said four finger receiving portions, and an outer side adjacent the air, said pinky receiving portion has a first insert proximal the proximal interphalangeal joint on said inner side, and a second insert proximal the distal interphalangeal joint on said inner side, and further having a first hump of glove material opposite said first insert and a second hump of glove material opposite said second insert, said first hump of glove material and said second hump of glove material are located on said outer side adjacent the air.

5. A glove receiving portion as claimed in claim 4 wherein on said pinky receiving portion said first insert is larger than said second insert.

6. A glove having four finger receiving portions and a thumb receiving portion whereby a fourth of said four finger receiving portions is an index finger receiving portion, said index receiving portion has a bottom side and a top side, an inner side adjacent a third of said four finger receiving portions, and an outer side adjacent said thumb receiving portion, said index finger receiving portion has a first insert proximal the proximal interphalangeal joint on said inner side, and a second insert proximal the distal interphalangeal joint on said inner side, and further having a first hump of glove material opposite said first insert and a second hump of glove material opposite said second insert, said first hump of glove material and said second hump of glove material are located on said outer side of said index finger receiving portion closest to said thumb receiving portion.

7. A glove receiving portion as claimed in claim 6 wherein on said index finger receiving portion said first insert is larger than said second insert.

* * * * *